US007975406B2

(12) United States Patent
Suzuki

(10) Patent No.: US 7,975,406 B2
(45) Date of Patent: Jul. 12, 2011

(54) DRIVING SHOES

(75) Inventor: Fujinori Suzuki, Akishima (JP)

(73) Assignee: I.B.M.I., Japan, Tokyo (JP)

( * ) Notice: Subject to any disclaimer, the term of this patent is extended or adjusted under 35 U.S.C. 154(b) by 824 days.

(21) Appl. No.: 11/987,938

(22) Filed: Dec. 6, 2007

(65) Prior Publication Data

US 2008/0134545 A1 Jun. 12, 2008

(30) Foreign Application Priority Data

Dec. 7, 2006 (JP) ..... 2006-330468

(51) Int. Cl.

| | |
|---|---|
| ***A43B 3/00*** | (2006.01) |
| ***A43B 5/00*** | (2006.01) |
| ***A43B 13/00*** | (2006.01) |
| ***A43B 23/28*** | (2006.01) |

(52) U.S. Cl. ..... 36/113; 36/103; 36/59 R; 36/131

(58) Field of Classification Search ..... 36/36 A, 36/8.3, 131, 103, 105, 113, 34 R, 59 R, 92, 36/72 B, 58.6, 127

See application file for complete search history.

(56) References Cited

U.S. PATENT DOCUMENTS

| | | | | |
|---|---|---|---|---|
| 3,169,327 | A * | 2/1965 | Fukuoka | 36/34 R |
| 4,043,058 | A * | 8/1977 | Hollister et al. | 36/102 |
| 4,224,749 | A * | 9/1980 | Diaz-Cano | 36/35 R |
| 4,439,936 | A * | 4/1984 | Clarke et al. | 36/102 |
| 4,641,438 | A * | 2/1987 | Laird et al. | 36/59 C |
| 5,699,628 | A * | 12/1997 | Boatwalla | 36/59 C |
| 5,974,699 | A * | 11/1999 | Park | 36/103 |
| 6,260,289 | B1 * | 7/2001 | Tsuji | 36/103 |
| 6,826,851 | B2 * | 12/2004 | Nelson, Jr. | 36/50.1 |
| 6,826,852 | B2 * | 12/2004 | Fusco | 36/103 |
| 7,096,603 | B2 * | 8/2006 | Fusco | 36/25 R |

FOREIGN PATENT DOCUMENTS

| | | |
|---|---|---|
| JP | U-S62-42406 | 3/1987 |
| JP | U-S63-163606 | 10/1988 |
| JP | U-H03-85905 | 8/1991 |
| JP | H11-253204 | 9/1999 |
| JP | H11-332603 | 12/1999 |
| JP | 2004-024811 | 1/2004 |
| JP | U3119808 | 2/2006 |

* cited by examiner

*Primary Examiner* — Jila M Mohandesi
*Assistant Examiner* — Melissa L Lalli
(74) *Attorney, Agent, or Firm* — Manabu Kanesaka

(57) ABSTRACT

A shoe for driving a car according to one aspect of the present invention comprises a heel part 5 on a foot sole 4 and an inclined face 5B increasing gradually toward a rear side in a side view. This inclined face 5B comprises a first face part 5*a* which is formed outside in a width direction and is capable of coming in contact with a car floor when depressing an accelerator pedal and a second face part 5*b* unlike the face condition of the above-mentioned first face part, which is formed inside in a width direction and is capable of coming in contact with a car floor when depressing a brake pedal.

9 Claims, 6 Drawing Sheets

DRIVING SHOES

The present disclosure relates to subject matter contained in Japan Patent Application No. 2006-330468 filed on Dec. 7, 2006, which is expressly incorporated herein by reference in its entirety.

BACKGROUND OF THE INVENTION

The present invention relates to a shoe suitable for driving a car. When driving a car, a driver usually depresses an accelerator pedal and a brake pedal alternately with the right foot. In this case, it is often difficult to drive a car with a general outdoor-use shoe as it is. For example, a high-heeled leather shoe, a high heel, or a sandal or the like has a structure whose heel's shape is not suitable for driving a car with the shoe as it is, and therefore, a heel part is caught on the car floor, which may interfere with a step-change operation of an accelerator pedal or a brake pedal during driving. Furthermore, particularly a high heel having a small cross section and a high heel is unstable when operating an accelerator pedal and a brake pedal, causing fatigue to increase.

In order to resolve the above-discussed problems, Japanese Published Unexamined Patent Application No. H8-229019 discloses a shoe for driving a car in which an inclined face is formed on a rear side of a heel part. According to this shoe for driving a car, when depressing an accelerator pedal or a brake pedal, a toe is floated from the car floor, and on the other hand an inclined face formed on a rear side of a heel part comes in contact with the car floor, which allows a driver to operate the pedals stably.

In the above-mentioned known shoe for driving a car, forming an inclined face on a rear side of a heel part enables a toe to float stably, however, in consideration of movement of a foot during step-change operation of an accelerator pedal and a brake pedal, it has still some room for improving the operability. In other words, in consideration of movement of a driver's right foot step-change operation during driving, it is preferable that a shoe for driving a car is properly designed so that stable step-change of both pedals can be carried out without moving a heel part dynamically to relieve the fatigue. Furthermore, in case of driving a car for a long time, it is easy to get stuffy in a shoe, which may interfere with comfortable driving.

It is therefore necessary to provide a shoe for driving a car with which an accelerator pedal and a brake pedal can be stably operated.

BRIEF SUMMARY OF THE INVENTION

In order to achieve the above-mentioned object, a shoe for driving a car according to the present invention comprises a shoe sole having a heel part and an inclined face formed in the rear side of the above-mentioned heel part increasing gradually toward a rear side formed in a side view, wherein the above-mentioned inclined face comprises a first face part which is formed outside in a width direction and is capable of coming in contact with a car floor when depressing an accelerator pedal and a second face part unlike the face condition of the above-mentioned first face part, which is formed inside in a width direction and is capable of coming in contact with a car floor when depressing a brake pedal.

According to the above-mentioned structure, forming the inclined face increasing gradually toward a rear side formed in a side view enables a toe to be floated in a stable condition when a foot sole (shoe sole) is transferred to the accelerator pedal or the brake pedal, which allows a stable depressing operation. Furthermore, this inclined face further comprises the first face capable of coming in contact with the car floor formed outside in a width direction when depressing the accelerator pedal and the second face which is different from the face conditions of that of the first face, capable of coming in contact with the car floor formed inside in a width direction when depressing the brake pedal, which enables easy step-change operations of the accelerator pedal and brake pedal by pivoting a toe side on the heel part (as much as possible without moving the heel part).

According to the shoe for driving a car of the present invention, a shoe for driving a car is provided in which both the accelerator pedal and brake pedal can be operated stably and comfortable driving can be carried out.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The embodiments of the shoe for driving a car (hereinafter referred to as a driving shoe) according to the present invention are hereinafter described with reference to the accompanying drawings.

Figure 1A:
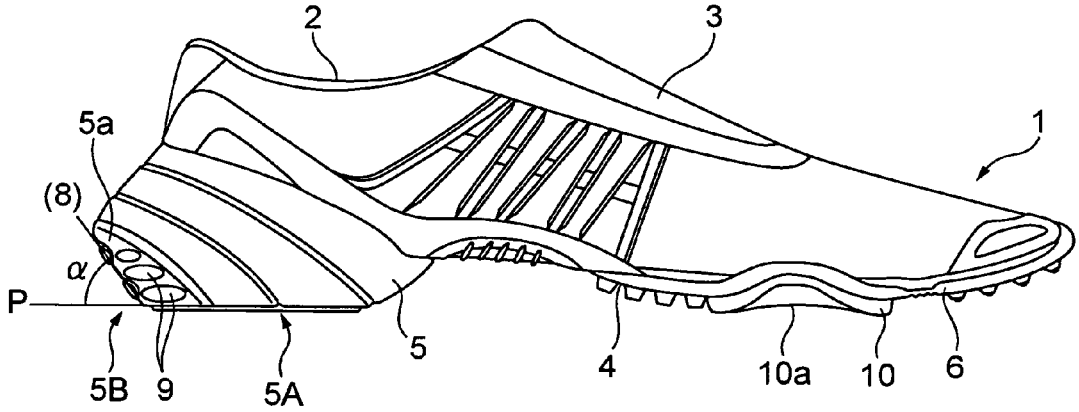
FIG. 1A is a side view (viewed from outside in a width direction) showing the overall structure of a shoe for driving a car to be worn on a right foot.
Figure 1B:
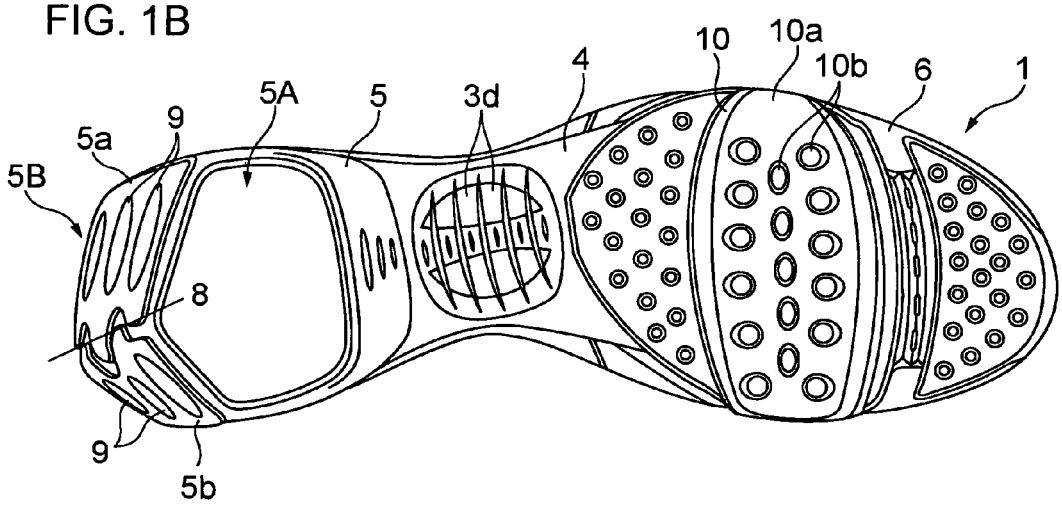
FIG. 1B is a bottom view showing the overall structure of a shoe for driving a car to be worn on a right foot.
Figure 1C:
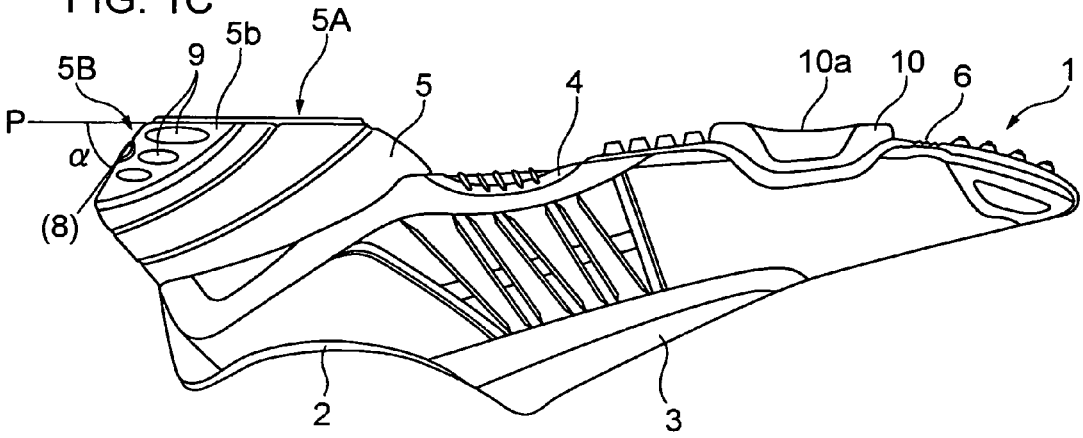
FIG. 1C is a side view (viewed from inside in a width direction) showing the overall structure of a shoe for driving a car to be worn on a right foot.
Figure 2:
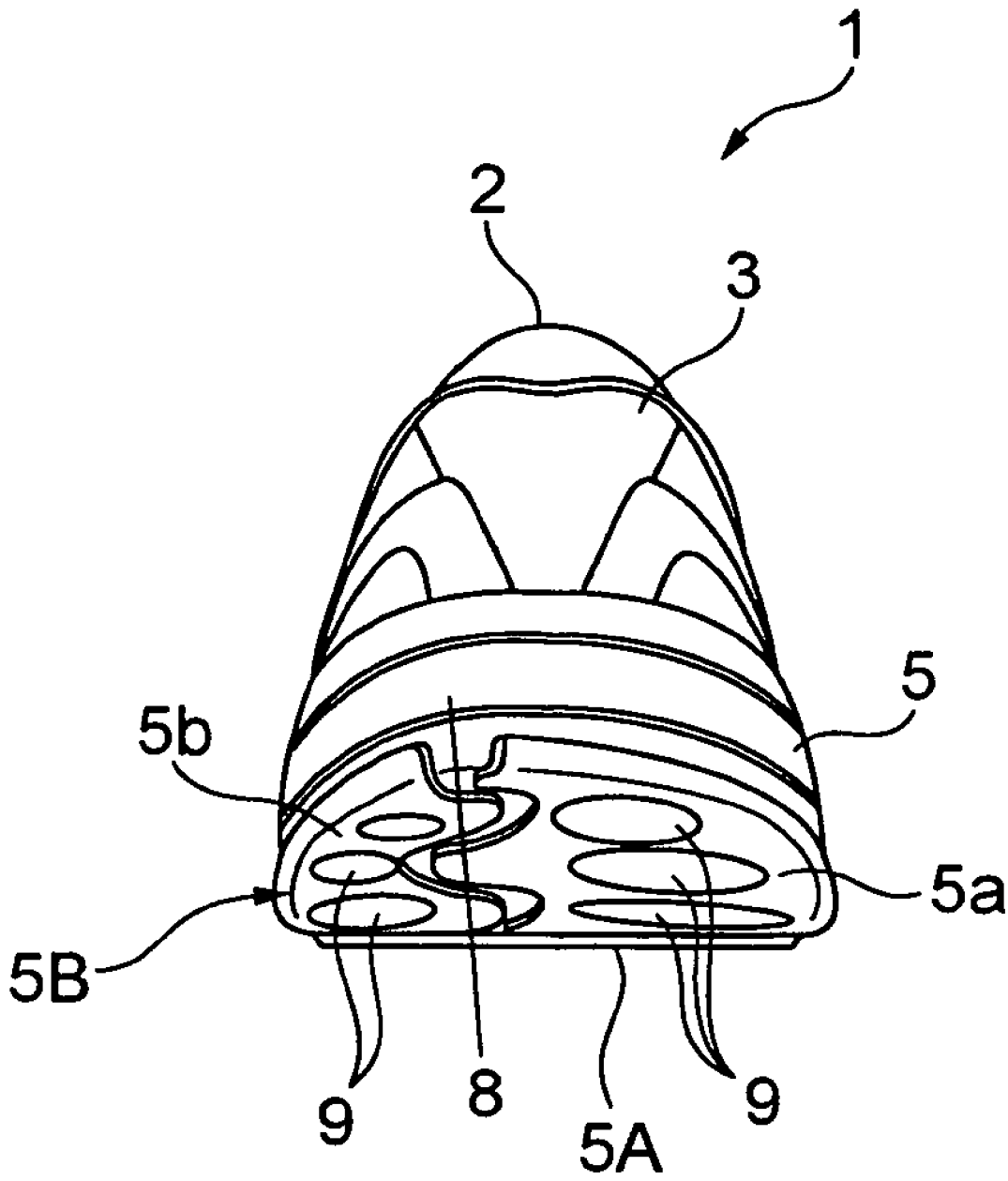
FIG. 2 is a rear view showing the shoe for driving a car shown in FIG. 1.

FIGS. 1A to 1C are views showing the overall structure of a driving shoe which is worn on a right foot, FIG. 1A is a side view viewed from the outside in a width direction, FIG. 1B is a bottom view, FIG. 1C is a side view viewed from the inside in a width direction, and FIG. 2 a view viewed from the rear side.

A driving shoe 1 according to the present embodiment, which has a structure to store the part lower than a driver's right ankle comprises a main body 3 provided with an opening 2 from which a leg part is inserted and a shoe sole 4 which is attached to the bottom side of the main body 3.

The above-mentioned main body 3 is a part to cover an instep of a right foot and preferably comprises a breathable material, and possibly, for example, nylon having a plenty of meshes, cotton or the like. Furthermore, it is preferable that the shoe sole 4 is a flexible material to follow the movement of the foot sole when a foot is inserted from the opening 2, for example, possibly comprises a rubber, a plastic and expandable materials, leather, or the like. Furthermore, the shoe sole 4 may be provided inside with a sockliner which comes in contact with a foot sole to improve foot comfort. This sockliner may be attached from the opening 2 and may have been attached to the shoe sole 3 beforehand.

The above-mentioned shoe sole 4 is provided with a heel part 5 on the rear side and with a pressing part 6 on the front side. This heel part 5 and the pressing part 6 may be integrated with the shoe sole 4.

The bottom side of the above-mentioned heel part 5 is provided with a horizontal part 5A which comes in contact with the ground when a driver wears the shoe and stands straight and an inclined face 5B which comes in contact with a car floor with a toe floated when placing a foot sole on an accelerator pedal and a brake pedal while driving a car.

In this case, the inclined face 5B has a shape increasing gradually toward the rear side in a side view. In other words, providing such an inclined face 5B enables a toe to be floated stably when placing a foot sole (shoe sole) on an accelerator pedal or a brake pedal, which allows stable depressing operations. If the inclination angle of the inclined face 5B (an angle inclined $\alpha$ toward a car floor P in a side view; an angle specified by the car floor and after-mentioned line 8) is too large, the bending angle of an ankle becomes larger, if the inclination angle is too small, it is difficult to maintain a condition where a toe is floated, therefore, the inclination angle is preferably set within the range between 20° and 45°.

Figure 3:
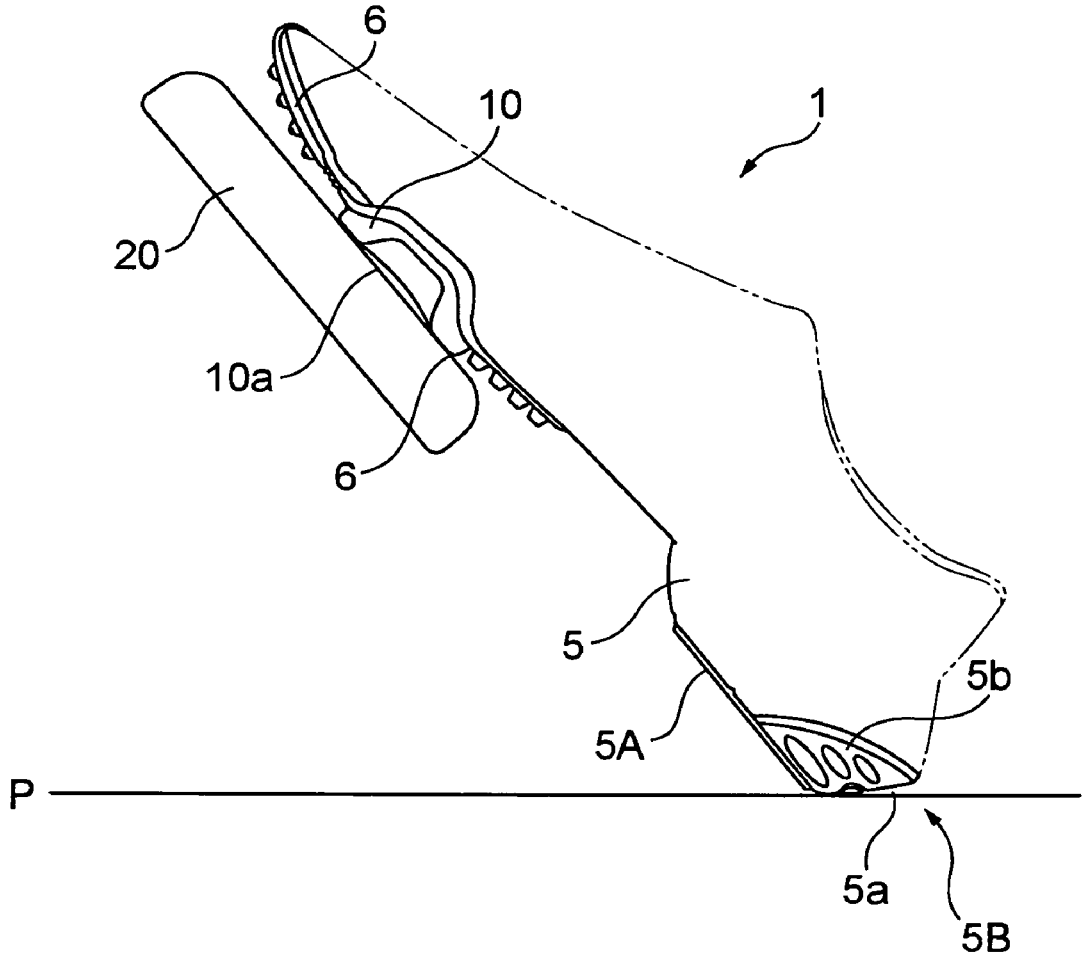
FIG. 3 is a view showing a contact condition of an inclined face when depressing an accelerator pedal.

Furthermore, the inclined face 5B is provided outside in a width direction on an outboard side with a first angled face part 5*a* which can come in contact with the car floor P when an accelerator pedal 20 is depressed and inside in a width direction on an inboard side with a second angled face part 5*b* unlike the face condition of the first face part 5*a* which can come in contact with the car floor P when a brake pedal 30 is depressed. (Refer to FIGS. 3 and 4.)

According to the present embodiments, both the first face part 5*a* and the second face part 5*b* are composed as a flat face, in which an inclined flat face increasing gradually toward the outside in a width direction (the first face part 5*a*) and an inclined flat face increasing gradually toward the inside in a width direction (the second face part 5*b*) from a line 8 which is slightly more inside than the center area of the inclined face 5B as a boundary. The boundary of the first face part 5*a* and the second face part 5*b* is formed by the edge line at the above-mentioned line 8, the both parts are not composed by a single face but the inclined faces 5B as multiple faces.

In addition, for the first face part 5*a* for an accelerator pedal and the second face 5*b* for a brake pedal which are formed in such an inclined 5B in consideration of actual driving conditions, since the time to depress the accelerator pedal 20 is longer than the time to depress the brake pedal 30, it is preferable that the area for the first face part 5*a* is designed to be larger as the area ratio (specifically, range between 50%-50% and 80%-20%). In other words, increasing the face area of the first face part 5*a* can maintain a stable condition in the time zone for driving for a longer time to relieve fatigue. Furthermore, it preferable that the surfaces of the first face part 5*a* and the second face part 5*b* are respectively provided with a concavo-convex part 9.

It is only necessary to design the structure in which the front side of the above-mentioned heel part 5 can be stably maintained in a condition where an accelerator pedal or a brake pedal is depressed, in other words, in a condition where the region of the inclined face 5B comes in contact with the car floor and a toe is floated. For example, in order to let the face stably come in contact with the car floor P, it is possible that a hard plate-like material such as resin or the like is attached to the surface of the block-like heel part 5 formed by foaming agent. Or, the heel part 5 itself may be integratedly formed in a block-like manner by a material having about 30 to 60 Hs hardness.

It is preferable that a plate-like material 10 having a concave curving part 10*a* curving toward a foot sole is attached to the above-mentioned pressing part 6. This plate-like material 10 is formed by comparatively hard materials such as carbon resin, or the like. As shown in FIG. 1, the plate-like material 10 may be attached directly to the pressing part 6 (foot sole 4) or may be pinched between the pressing part 6 (shoe sole 4) and the sockliner. Providing such a plate-like material 10 can relieve fatigue and pain, therefore, even if brake operation is performed during driving for a long time, a brake pedal can be depressed without feeling any fatigue or discomfort. Of course, such a plate-like material 10 may be integratedly formed with the pressing part 6 (shoe sole 4).

Figure 4:
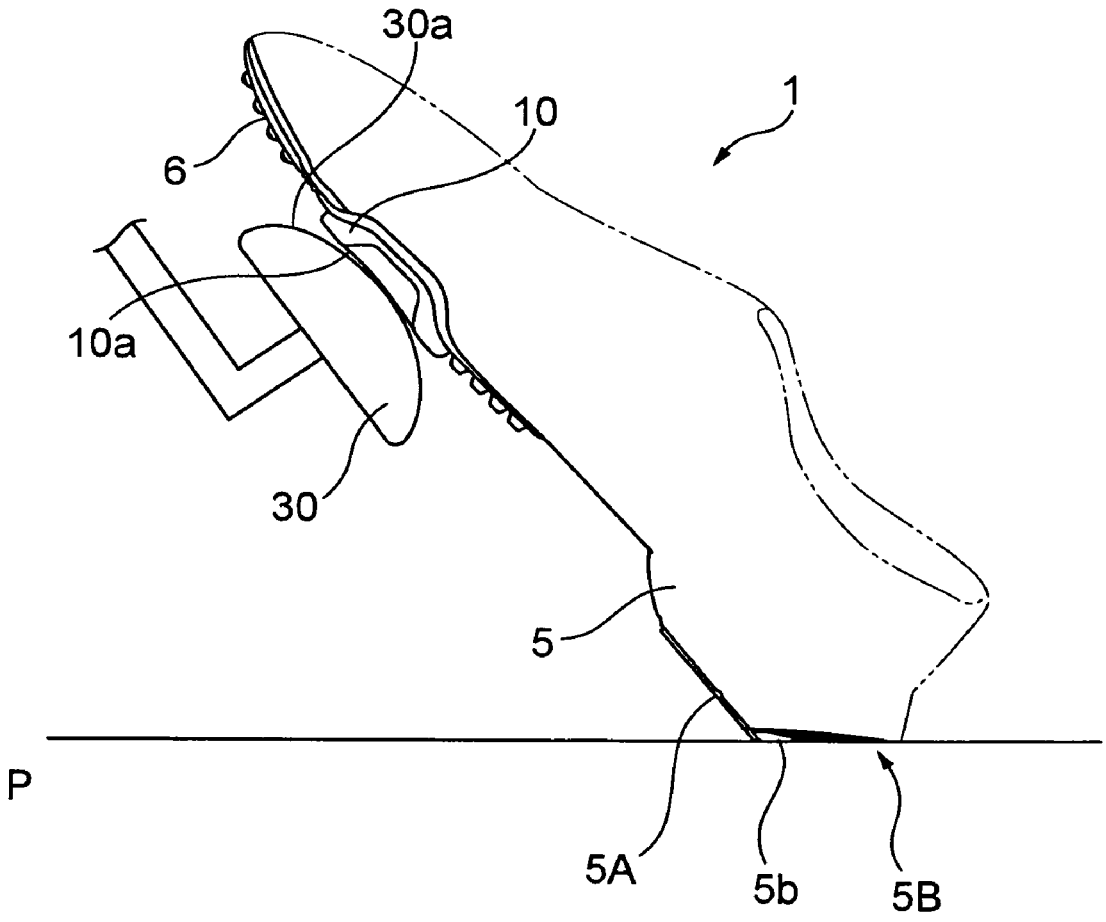
FIG. 4 is a view showing a contact condition of an inclined face when depressing a brake pedal.

Furthermore, as shown in FIG. 4, a car brake pedal 30 is usually designed in which a surface 30*a* is spread in a width direction and formed in a curved-like manner, therefore, providing the plate-like material 10 with the above-mentioned concave curving part 10*a* can improve adhesion to the surface 30*a* of the car brake pedal 30. In other words, a depressing force can be transferred to the brake pedal 30 easily only by depressing some part (a part provided with the plate-like material 10 formed by a hard material) instead of depressing the brake pedal 30 with a whole foot sole, which enables relieving fatigue during operation.

In this case, it is preferable that the curvature of the concave curving part 10*a* is the curvature of the surface 30*a* on the car brake pedal 30, however, as shown in FIG. 4, it is only necessary that the curvature of the concave curving part 10*a* is larger than the curvature of the surface 30*a* on the car brake pedal 30. Thus, increasing the curvature of the concave curving part 10*a* enables contact with the surface 30*a*, which allows stable braking operations.

Furthermore, the above-mentioned plate-like material 10 is provided with plenty of breathing holes 10*b* and designed to suppress stuffiness in the main body 3. Furthermore, in order to increase the breathability to the main body, it is only necessary that a plantar arch area of the shoe sole 4 is provided with plenty of breathing holes 3*d*.

Figure 5:
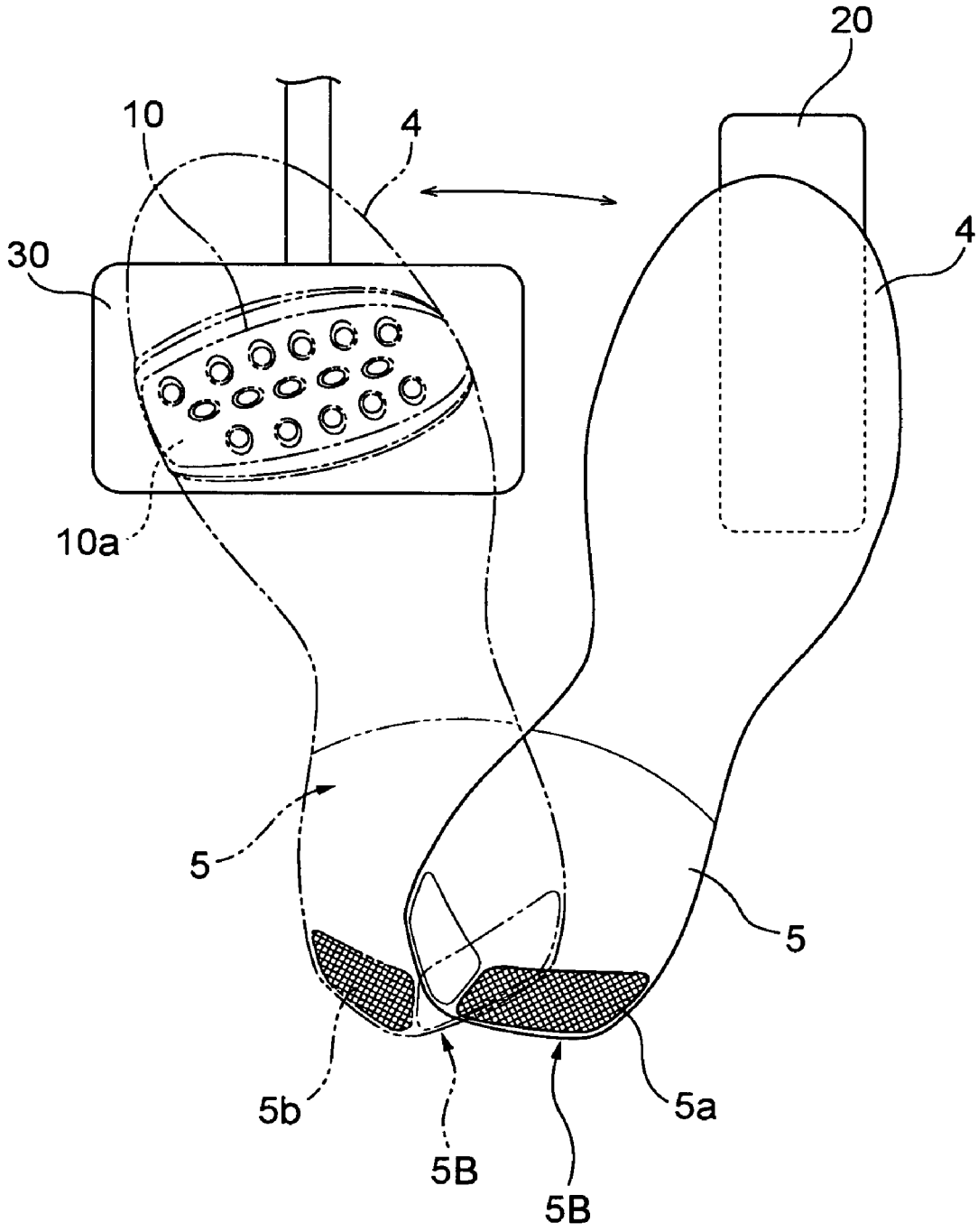
FIG. 5 is a view showing a step-change operation of an accelerator pedal and brake pedal.

According to the heel part 5 having the above-mentioned structure, as shown in FIG. 5, only pivoting the toe side in the arrow's direction on the area of inclined face 5B on the heel part 5 (without moving the heel part in a width direction) enables easy step-change operations of accelerator and brake pedals. In other words, since the heel part 5 is not moved in a horizontal direction during operation, the heel part is not caught on the car floor, which relieves fatigue. Furthermore, when the accelerator pedal 20 or the brake pedal 30 is depressed, the above-mentioned heel part structure and the shape of the inclined face 5B enables stable positions and conditions to be maintained.

Figure 6:
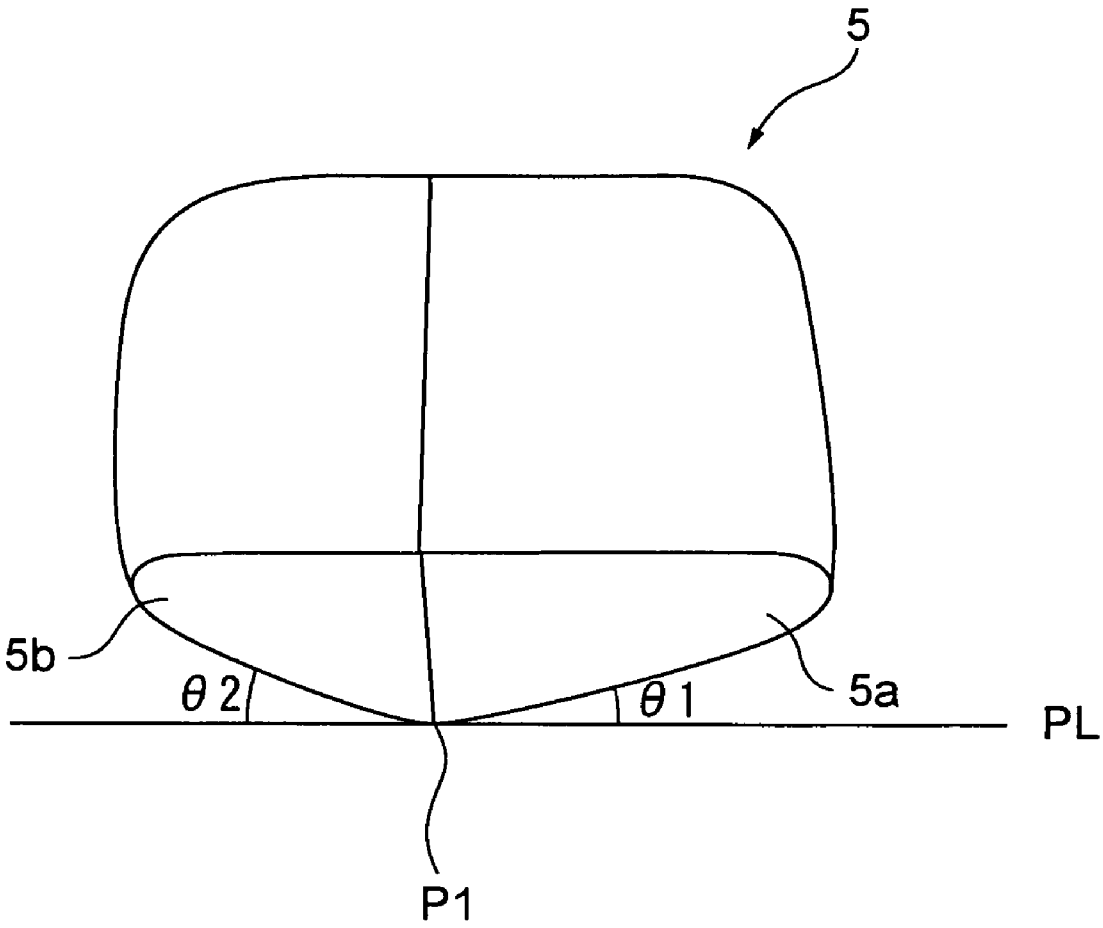
FIG. 6 is a view showing a condition of each face when a heel comes in contact with a floor.

Furthermore, as shown in FIG. 6, if the first face part 5*a* and the second face part 5*b* are designed to be an inclined flat face increasing gradually along the line 8 as an edge line, it is preferable that when the horizontal part 5A (Refer to FIG. 1) of the heel part 5 comes in contact with the car floor normally, the heel part 5 is provided so that the inclination angles θ1 and θ2 at the supporting point (contact point) P1 of the line 8 to the horizontal line PL for each face part is 10 to 40° and 20 to 50°. Deigning as above mentioned enables a driver to change step easily from the accelerator pedal to the brake pedal only by moving the toe leftward on the axis of the supporting point P1.

The embodiments according to present invention are described above, however, present invention is not limited to the above-mentioned embodiments but can be changed in diversified styles.

For example, in the above-mentioned structure, it is only necessary that the inclined face 5B formed in the rear side of the heel part 5 includes at least the above-mentioned first face 5*a* and multiple faces having the second face 5*b* unlike the surface conditions of this first face part 5*a*. In this case, it is only necessary that the first face part 5*a* and the second face part 5*b* are respectively formed in multiple faces with different conditions but that a single face or the edge line is formed to identify each face part significantly as above mentioned. Or, it is only necessary that each face part is formed as a curved-like face with different conditions with each other but is not formed as an inclined flat face. Or furthermore, it is only necessary that the inclined face 5B is provided with 3 or more faces with different conditions.

Furthermore, since the use object according to the present invention is limited to use during driving a car, a durable structure required for supporting human's weight and a water-resistant structure to protect the shoe from moisture, or the like is not taken into consideration. For this reason, it is possible that the shoe is made of a weight-reduced material as much as possible or a breathable material. Furthermore, it is possible that a breathing hole to improve the breathability of each part is provided in each part. Furthermore, it is only necessary that the main body 3 has a structure covering a foot partially, for example, a structure like a sandal instead of covering a whole instep. In addition, for a shoe for the left foot with which accelerating/braking operations are not performed, the structure is not limited and a shoe having a symmetric shape to that of right foot may be provided for actual sales or a shoe exclusive for right foot may be sold.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A driving shoe for driving a car, comprising:

a shoe sole and a flat heel part; and an inclined face formed on a rear side of said flat heel part, the inclined face being inclined relative to the flat heel part to further gradually extend toward a rear of the driving shoe;

wherein said inclined face comprises:

a first angled face part formed on an outboard side of the inclined face and which is configured to contact a portion of a car floor and angle the shoe sole toward engagement with an accelerator pedal, the first angled face part being composed as a first flat face and including a plurality of concavo-convex parts, and a second angled face part which is contiguous with said first angled face part, formed on an inboard side of the inclined face, and which is configured to contact the portion of the car floor and angle the shoe sole toward engagement with a brake pedal, the second angled face part being composed as a second flat face and including a plurality of concavo-convex parts;

wherein the first and second angled face parts face rearwardly and downwardly when the driving shoe is placed on a flat surface while the first angled face part faces outwardly of the driving shoe and the second angled face part faces inwardly of the driving shoe; and wherein the first and second angled face parts have a boundary therebetween forming a rearmost part of the driving shoe in a longitudinal direction thereof.

2. The driving shoe for driving a car according to claim 1, wherein said first angled face part includes a surface area, which is larger than a surface area of said second angled face part.

3. The driving shoe for driving a car according to claim 1, wherein said shoe sole is provided with a car pedal engaging concave curving part across a width of the shoe sole.

4. The driving shoe for driving a car according to claim 1, wherein an inclination angle of said inclined face is set within a range between 20° and 45°.

5. The driving shoe for driving a car according to claim 1, wherein the first flat face and the second flat face are inclined with respect to one another.

6. The driving shoe according to claim 1, wherein the driving shoe is a shoe for a right foot.

7. The driving shoe according to claim 3, wherein the concave curving part comprises a material which is harder than a material of the remainder of the sole.

8. The driving shoe according to claim 3, wherein the concave curving part comprises a plurality of first breathing holes.

9. The driving shoe according to claim 8, wherein the sole comprises second breathing holes between the heel part and the concave curving part.

* * * * *